US005311742A

United States Patent [19]

Izumi et al.

[11] Patent Number: 5,311,742

[45] Date of Patent: May 17, 1994

[54] GAS TURBINE COMBUSTOR WITH NOZZLE PRESSURE RATIO CONTROL

[75] Inventors: Atsuhiko Izumi; Masao Itoh, both of Yokohama, Japan

[73] Assignee: Kabushiki Kaisha Toshiba, Kawasaki, Japan

[21] Appl. No.: 982,583

[22] Filed: Nov. 27, 1992

[30] Foreign Application Priority Data

Nov. 29, 1991 [JP] Japan ..... 3-315671

[51] Int. Cl.[5] ..... F23R 3/34

[52] U.S. Cl. ..... 60/742; 60/743

[58] Field of Search ..... 60/747, 742, 733, 746

[56] References Cited

U.S. PATENT DOCUMENTS

| | | | |
|---|---|---|---|
| 4,193,260 | 3/1980 | Carlisle | 60/746 |
| 4,344,280 | 8/1982 | Minakawa et al. | 60/747 |
| 4,735,052 | 4/1988 | Maeda et al. | 60/733 |

FOREIGN PATENT DOCUMENTS

| | | | |
|---|---|---|---|
| 0198502 | 10/1986 | European Pat. Off. | 60/747 |
| 0381079 | 8/1990 | European Pat. Off. | 60/747 |
| 0258929 | 11/1986 | Japan | 60/733 |
| 2309123 | 12/1990 | Japan . | |

*Primary Examiner*—Richard A. Bertsch
*Assistant Examiner*—Timothy S. Thorpe
*Attorney, Agent, or Firm*—Oblon, Spivak, McClelland, Maier & Neustadt

[57] ABSTRACT

A gas turbine combustor for a gas turbine power plant comprises a combustion liner connected to a turbine and provided with a main fuel nozzle assembly and a sub-fuel nozzle assembly for jetting fuel to an inside of the combustion liner through nozzle holes, a base fuel supply line, a main fuel line for supplying a fuel to the main nozzle assembly for premixing an air with the fuel jetted through the nozzle hole for carrying out a lean burning in the combustion liner, and a plurality of sub-fuel lines for supplying the fuel to the sub-fuel nozzle assembly for mixing the fuel with a combustion air for carrying out a diffusion burning in the combustion liner. The main and sub-fuel lines branch off a front end of the base fuel supply line. Distributing valves are incorporated in the main fuel line and at least one of the sub-fuel lines for distributing the fuel into the main and sub-fuel lines and degree of openings of the distributing valves are controlled by a control unit for controlling a fuel distribution ratio. The sub-fuel nozzle assembly includes a swirler provided with swirling vanes at an end portion inserted in the combustion liner for swirling the fuel therein The swirling vanes are provided with a combustion air passage to which the nozzle holes of the sub-fuel nozzle assembly are opened.

3 Claims, 10 Drawing Sheets

GAS TURBINE COMBUSTOR WITH NOZZLE PRESSURE RATIO CONTROL

BACKGROUND OF THE INVENTION

The present invention relates to a gas turbine combustor and, more particularly, is concerned with a low NOx gas turbine combustor provided with a main-fuel line of a pre-mixing lean-burn system and a sub-fuel line of a diffusion combustion system.

In general, a main factor for the generation of NOx in a gas turbine combustor resides in that a combustion area in which an equivalent ratio of fuel and air is nearly "1" is formed in a combustion gas and a temperature of the combustion gas in this combustion area is locally highly raised.

The NOx thus generated due to such factor is suppressed in conventional art by mixing a supply fuel with an air of an amount more than that necessary for the combustion to dilute the mixture or by supplying, to the combustion area, the mixture in which the fuel is preliminarily uniformly mixed with the air.

Concerning the pre-mixing lean-burn system, a combustor system has been generally utilized which is provided with a main fuel line of the pre-mixing lean-burn system and a sub-fuel line of the diffusion combustion system, in consideration of covering a wide operation range. This is based on the fact that the pre-mixing lean burn system is superior for the low NOx burning, but another diffusion combustion system is required in order to keep a combustion flame in a wide operation range.

FIG. 6, mentioned hereinlater, shows one example of a conventional gas turbine combustor, in which a downstream end of a fuel supply base line 2 for supplying a fuel is branched, for a combustion liner 3, into a main fuel line 4 for the pre-mixing lean-burning and a sub-fuel line 5 for the diffusion combustion. The generation of the NOx largely depends on the fuel supply ratio in the diffusion combustion line 5, so that, in order to reduce the generation of the NOx, it is desired to possibly minimize the combustion in the diffusion combustion line 5.

Usually, in the gas turbine combustor, an air-fuel ratio is made small from an ignition time to an intermediate load operation time for a gas turbine, a temperature of the flame is hence low, and the NOx is less generated, so that the pre-mixing lean-burning line as the main fuel line 4 is not utilized and the operation control of the gas turbine can be mainly made through the diffusion combustion line as the sub-fuel line 5.

However, in a load operation period of the gas turbine after the switching to the intermediate load operation mode, distribution of the fuel supply to the main fuel line 4 and the sub-fuel line 5 is regulated by locating a fuel flow rate control valve 6 and fuel distributing valves 7 and 8 for the main and sub-fuel lines 4 and 5, respectively, and controlling degrees of openings of these valves 7 and 8 by a fuel supply control unit 9 in consideration of requirement for a gas turbine operation start mode and a load operation mode.

In the gas turbine combustor of the structure described above, however, the distribution of the fuel into the main fuel line and the sub-fuel line with respect to the respective operation modes is controlled as shown in FIG. 7, mentioned hereinlater. Accordingly, it becomes important to suitably design main and sub-fuel nozzles 10 and 11 so as to conform with the fuel flow rates, and namely, it is necessary to suitably set fuel nozzle areas. The fuel flow rates passing the main and sub-fuel nozzles 10 and 11 are decided by fuel rates at fuel inlet ports, a pressure difference between pressures before and after the passing of the main and sub-fuel nozzles 10 and 11, and the fuel nozzle areas.

A fuel supply pressure necessary for the flow rate of the supply fuel with respect to the fuel nozzle area changes as shown in FIG. 8, mentioned hereinlater, but the sub-fuel line generates a peak pressure against the rapid change of the required fuel at a point before and after the switching load described above. As will be understood from FIG. 8, in the load range of 0 to 100 %, the maximum fuel supply pressure is not decided on the main fuel nozzle at the 100 % load time, but decided by the sub-fuel nozzle at a load point before and after the above switching load. This is based on the fact that, generally, with respect to the setting of the fuel nozzle area, the nozzle pressure ratio, i.e. (fuel supply inlet pressure)/(nozzle outlet pressure), at the fuel nozzle portion will cause instable phenomenon such as combustion oscillations when the ratio becomes below a certain limit value, and for this reason, the nozzle areas of the fuel nozzles of the main and sub-fuel lines 4 and 5 so that the nozzle pressure becomes higher than the limit nozzle pressure ratio in all the operation range.

Particularly, with respect to the sub-fuel line 5, the fuel nozzle area is set so that the nozzle pressure ratio becomes larger than the limit nozzle pressure ratio in the operation range at an operation load of more than the switching load at which the fuel nozzle ratio is likely made small. On the contrary, in the operation range below the switching load, it is necessary to solely flow the fuel likely as the conventional gas turbine combustor. Accordingly, with respect to the small fuel nozzle area, the supply gas pressure is to be made considerably high in comparison with the conventional diffusion combustion type gas turbine combustor as shown in FIG. 8, thus being troublesome.

As described hereinbefore, since the amount of the NOx generated in the combustor depends mainly on the location of the diffusion combustor in the sub-fuel line 5, in order to reduce the generation of the NOx during the operation mode more than the switching load, it will be necessary to possibly reduce the distribution of the fuel to the sub-fuel line 5. Accordingly, in this meaning, the fuel supply pressure peak becomes more remarkable as the reduction of the NOx is strongly intended. Furthermore, in a large-sized power plant, the supply gas fuel is supplied by increasing a pressure of the low liquid state fuel to a working pressure by means of a pump and then supplying the same in a gas state, but in an intermediate or small sized power plant or in a city use power plant, a gas of a low pressure of about 0.5 to 1.5 $kg/cm^2$ is supplied to the gas turbine combustor by increasing its pressure to a pressure necessary for the gas turbine combustor. Accordingly, when the supply gas fuel pressure increases as in the conventional example described above, not only the working power of the gas fuel compressor increases but also the design of the gas fuel compressor becomes itself difficult, and a pressure withstanding capability of the associated equipments or machinaries must be made increased, resulting in adverse plant working efficiency, cost-up and problem of stable operation.

SUMMARY OF THE INVENTION

An object of the present invention is to substantially eliminate defects or drawbacks encountered in the prior art and to provide a gas turbine combustor of a simple structure capable of ensuring a sufficient limit nozzle pressure ratio in a full operation range under a supply gas fuel pressure utilized in a gas turbine combustor of a conventional structure and performing a stable operation with reduced NOx generation.

This and other objects can be achieved according to the present invention by providing a gas turbine combustor for a gas turbine power plant comprising a combustion liner operatively connected to a turbine and provided with a main fuel nozzle assembly and a sub-fuel nozzle assembly for jetting fuel to an inside of the combustion liner through nozzle holes of the fuel nozzle assemblies, a base fuel supply line having one end connected to a fuel source, a main fuel line for supplying a fuel through the base fuel line to the main nozzle assembly for premixing an air with the fuel jetted through the nozzle hole for carrying out a lean-burning in the combustion liner, and a sub-fuel line for supplying the fuel through the base fuel supply line to the sub-fuel nozzle assembly for mixing the fuel with a combustion air for carrying out a diffusion burning in the combustion liner, the main and sub-fuel lines being composed of by branching another end of the base fuel supply line, wherein a plurality of sub-fuel lines are replaced with one sub-fuel line, the sub-fuel lines being branched at another one end of the base fuel supply line, distributing valve assemblies are incorporated with the main fuel line and at least one of the sub-fuel lines on the way thereof for distributing the fuel into the main and sub-fuel line and the degree of openings of the distributing valve assemblies are controlled by a control unit for controlling a fuel distribution ratio to the main and sub-fuel lines.

In a preferred embodiment, the sub-fuel nozzle assembly for the sub-fuel line includes a swirler provided with swirling vanes at an end portion inserted in the combustion liner for swirling the fuel therein. The swirling vanes are provided with a combustion air passage to which the nozzle holes of the sub-fuel nozzle assembly are opened.

Further natures and features of the present invention will be made more clear hereunder through description with reference to the accompanying drawings.

DESCRIPTION OF THE PREFERRED EMBODIMENTS

Figure 9:
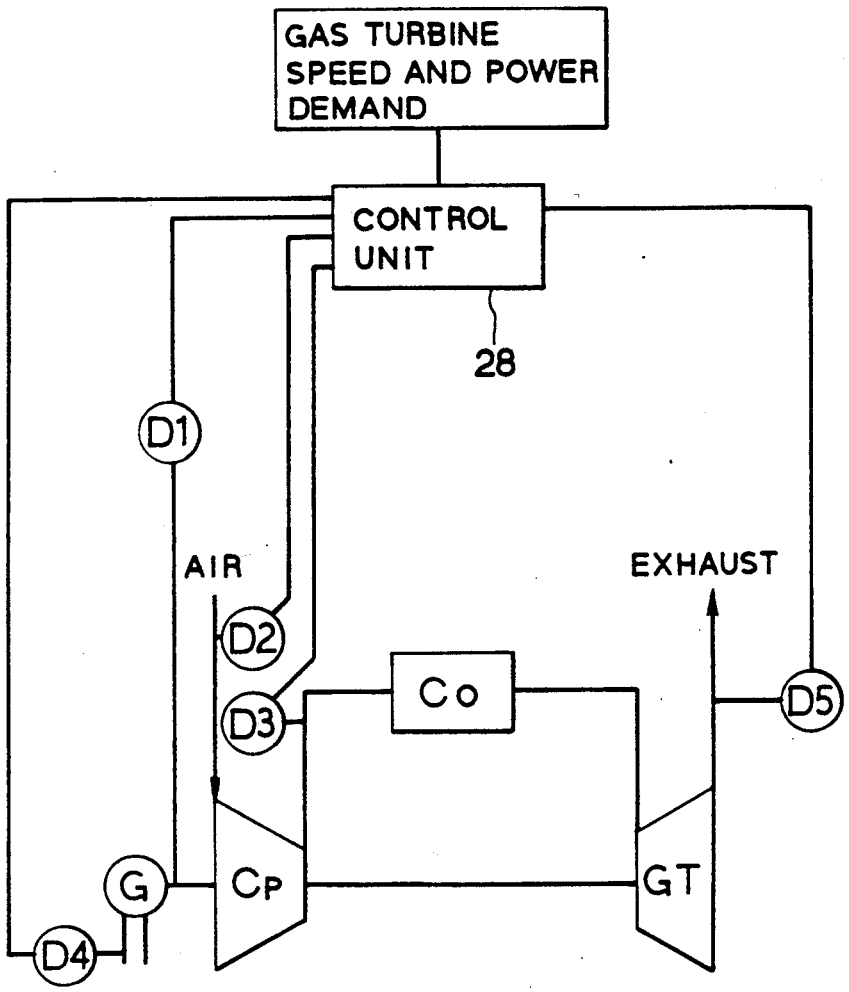
FIG. 9 is a brief diagram of a gas turbine power plant to which the present invention is applicable.

First, referring to FIG. 9, showing a diagram of a gas turbine power plant of a general structure having a gas turbine GT, a combustor Co, and a compressor Cp, which are operatively connected and also connected to a control unit 28. To the control unit 28 is connected a gas turbine speed and power demand. Further, the above mentioned respective units are connected through signal lines incorporated with detectors for detecting operational factors. Reference numerals D1, D2, D3, D4 and D5 denote shaft speed detector, air temperature detector, compressor discharge pressure detector, electric power detector and exhaust temperature detector, and G denotes a generator. Of course, although other elements or members such as valve means are incorporated in the gas turbine power plant, they are eliminated in FIG. 9 and some valve means in association with the combustor according to the present invention are shown in the other figures mentioned hereinlater.

Figure 1:
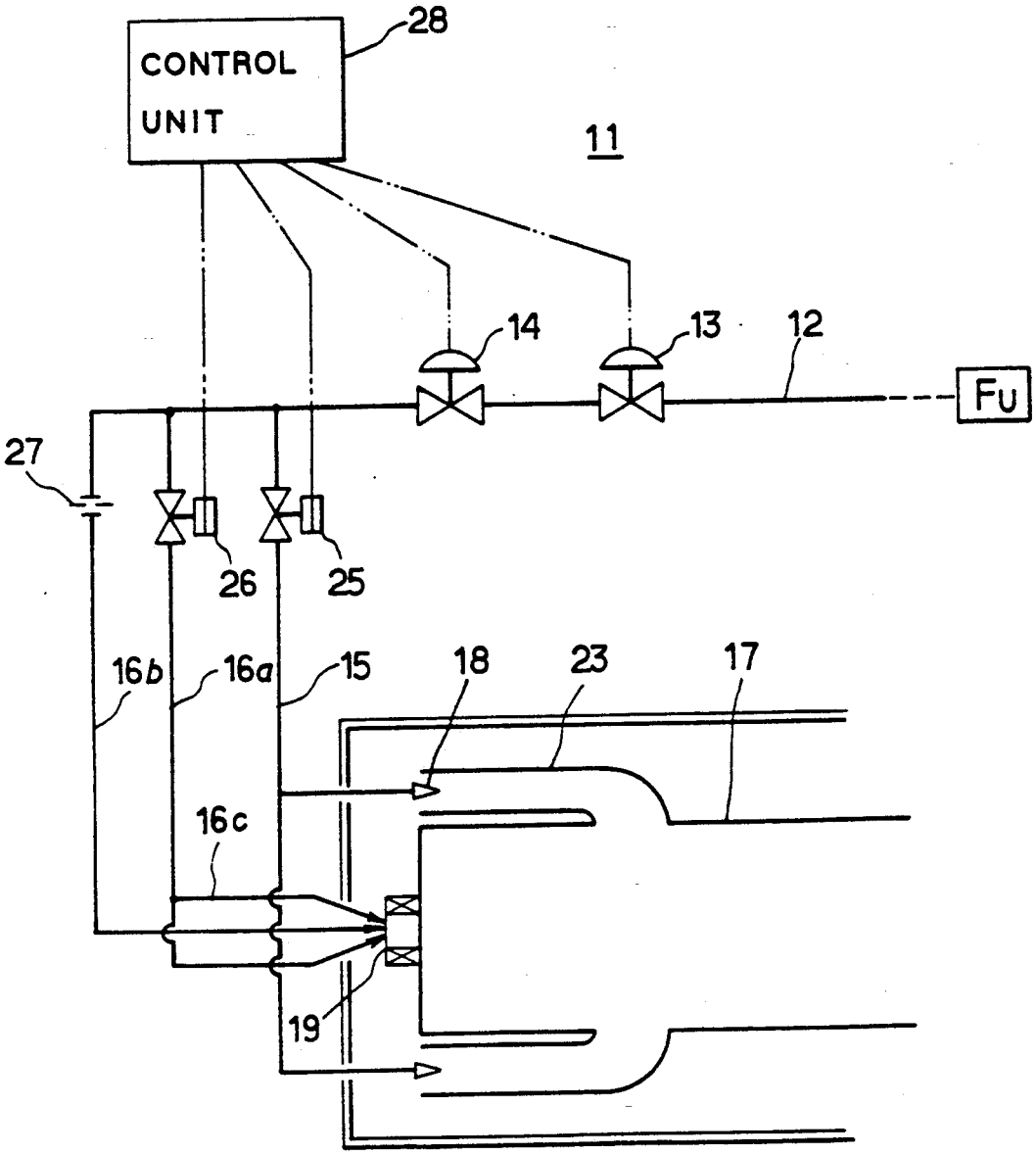
FIG. 1 is a system diagram of a gas turbine combustor according to the present invention.

A preferred embodiment of a gas turbine combustor according to the present invention will be described hereunder first with reference to FIG. 1 showing a system diagram of the combustor of a gas turbine power plant of the structure of FIG. 9.

Referring to FIG. 1, a gas turbine combustor Co is incorporated with a base fuel line 12 connected to a fuel supply source Fu and incorporated on the way thereof with a fuel stop valve 13 on the fuel upstream side for stopping the fuel supply by closing the valve 13 and a fuel flow rate control valve 14 on the downstream side thereof for controlling the fuel supply flow rate by adjusting a degree of opening of the valve 14.

Figure 2A:
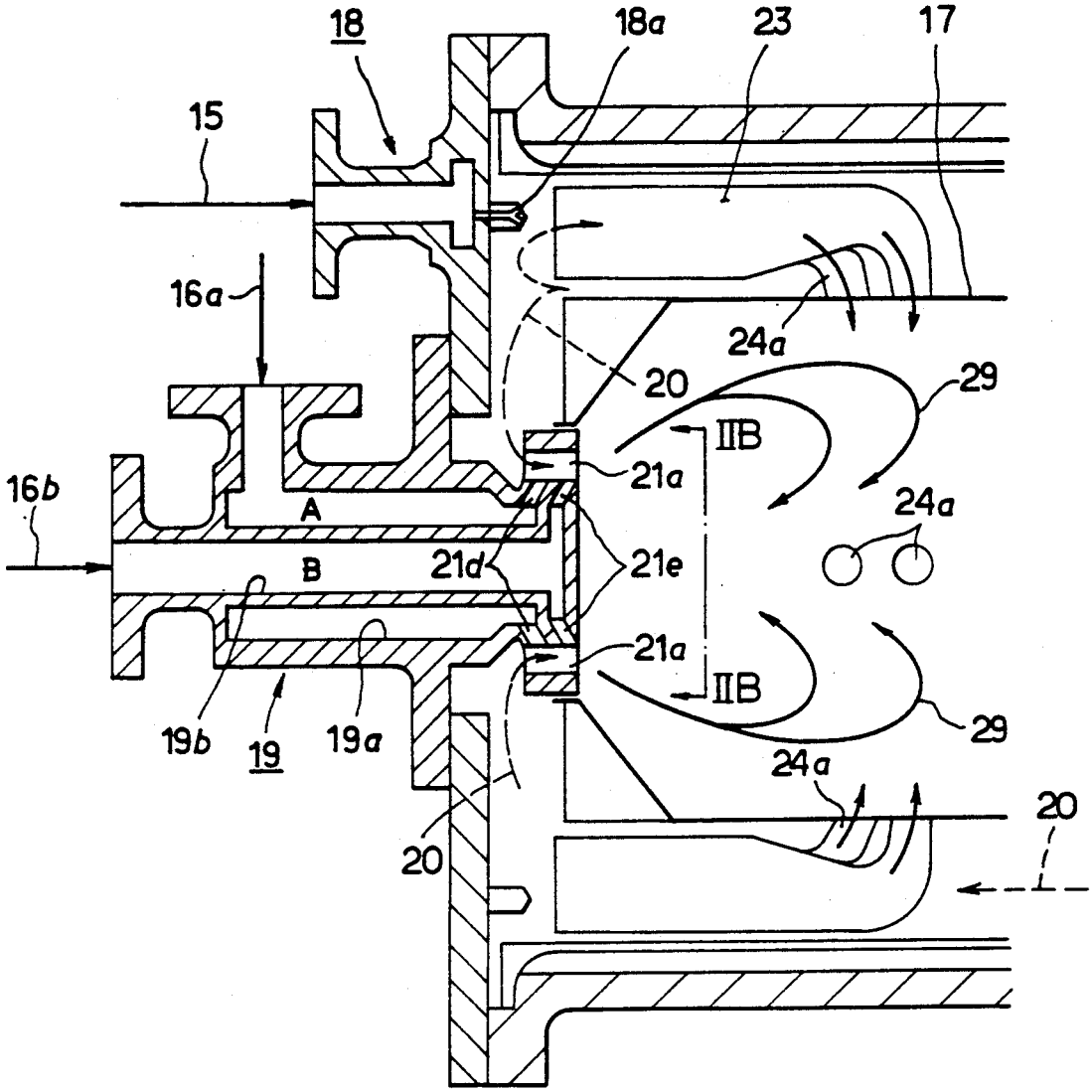
FIG. 2A is a sectional view, in part, of the gas turbine combustor of FIG. 1, in an enlarged scale.

The base fuel line 12 is branched at its downstream end portion into one main fuel line 15 and a plurality of, two **16*a* and 16*b* in the illustrated embodiment, sub-fuel lines. The front, i.e. downstream side end, of a sub-fuel nozzle 19 is positioned to an approximately central portion of a header portion of a combustion liner 17 as shown in FIG. 2A to diffuse the fuel from the sub-fuel lines and always keep a circulated flame. One 16*a* of the sub-fuel lines is connected to an outer pipe 19*a*, and another one 16*b* of the sub-fuel lines is connected to an inner pipe 19*b* which is coaxially mounted in the outer pipe 19*a* for constituting a double-pipe structure of the sub-fuel nozzle 19. A line 16*c* branched from the sub-fuel line 16*a*** is a fuel line for ignition of the combustor.

The sub-fuel nozzle 19 has an inner, lefthand as viewed, end slightly extending inside the header portion of the combustion liner 17, and a swirler 21 is coaxially mounted on the outer periphery of the inner end of the sub-fuel nozzle 19. The swirler acts to swirl a combustion air 20, shown with dotted line in FIG. 2A, discharged from a compressor Cp by means of swirling vanes **21*a* of the swirler 21 thereby to feed the combustion air into the combustion liner 17**.

Figure 2B:
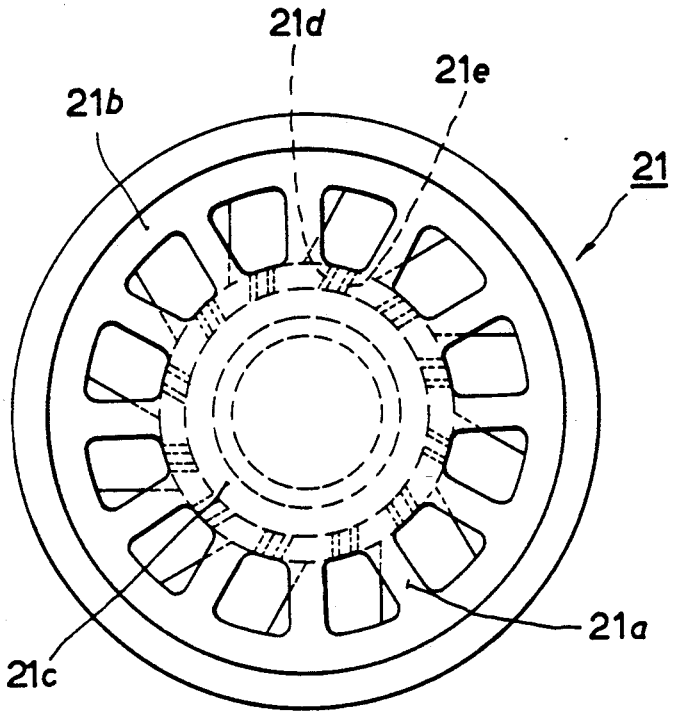
FIG. 2B is a front view of a swirler, in an enlarged scale, provided with swirling vanes as viewed from an arrowed direction IIB—IIB of FIG. 2A.

As shown in FIG. 2B, the swirler 21 comprises an outer ring **21*b*, an inner ring 21*c*, and swirling vanes 21*a*** arranged in the circumferential direction with equal spaces of the inner ring 21c. Reference numerals 21d and 21e denote fuel flow holes.

A plurality of nozzle ports or holes 22a,—and 22b—are formed to the front end portions of the respective outer and inner pipes 19a and 19b of the sub-fuel nozzle 19 and these nozzle holes 22a and 22b are opened to a combustion air circulation passage in swirling vanes 21a of the swirler 21 at positions and with orientations so that the combustion air 20 can be sufficiently preliminarily mixed with the fuel jetted from the nozzle holes 22a and 22b. The swirler 21 is provided with a combustion gas passage communicated with the combustion air passage and is also communicated with a pre-mixing duct 23 formed to the peripheral portion of the combustion liner 17 on the side of its header portion.

A main fuel nozzle 18, on the other hand, is mounted to a header plate of the combustion liner 17 for the purpose of carrying out a lean burning with an assistance of the flame due to the diffusion combustion by means of the sub-fuel nozzle 19 and the swirler 21. The main fuel nozzle 18 is provided with a main nozzle port or hole 18a which is communicated with the pre-mixing duct 23 thereby to preliminarily mix the fuel jetted through the main nozzle port 18a in a diluted manner with the combustion air 20 uniformly. This diluted fuel mixture is flown into the combustion liner 17 uniformly through a plurality of outlet ports 24a, 24a formed to the pre-mixing duct 23. The inwardly oriented angles and the swirling angles of the swirling vanes 21a of the swirler 21 are set so that the premixture fuel can be burned optimumly.

Further, as shown in FIG. 1, the main fuel line 15 is incorporated on the way thereof with a main distributing valve 25, one 16a of the sub-fuel lines is incorporated on the way thereof with a sub-distributing valve 26 and the other one 16b of the sub-suel lines is incorporated on the way thereof with a fixed orifice 27.

These main and sub-distributing valves 25 and 26, the fuel stop valve 13 and the fuel flow rate control valve 14 are electrically connected to a fuel supply control unit 28 through signal lines respectively shown in FIG. 1 by two-dot-and-dash lines, and under the control of the control unit 28, the degrees of these valves can be controlled. To the fuel supply control unit 28 are operatively connected to the compressor Cp and a gas turbine GT through electric signal lines as briefly shown in Fg. 9.

Figure 7:
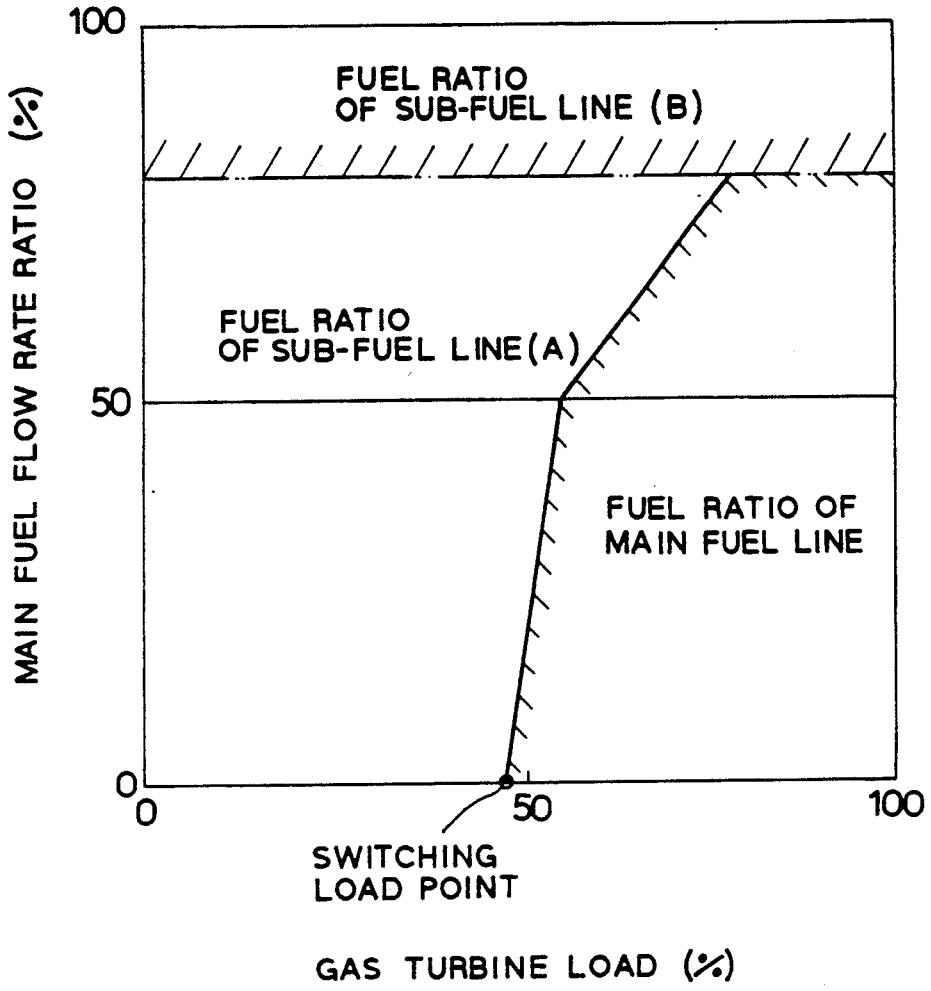
FIG. 7 is a graph showing fuel distribution changes in the main and sub-fuel lines.

The gas turbine control unit 28 performs its operation in accordance with the fuel distribution schedules shown in FIG. 7, for example, and controls the degrees of openings of the respective valves 13, 14, 25 and 26.

The operation of the gas turbine combustor according to the embodiment described above will be described hereunder.

At first, the gas turbine GT is driven till its driving speed reaches about 15 to 30 % of a rated speed, at which the gas turbine is capable of being ignited by the operation of a starting device. Under this condition, the fuel supply control unit 28 operates to open the fuel stop valve 13 and adjusts the degree of opening of the fuel flow rate control valve 14 for supplying a fuel required for the ignition. At this moment, the main distributing valve 25 is closed and the sub-distributing valve 26 is fully opened. The operative relationship between the main and subdistributing valves 25 and 26 is determined solely by the gas turbine load such as shown in FIG. 7, and the main distributing valve 25 is kept to its closed state under the switching to the ignitionable state.

Figure 8:
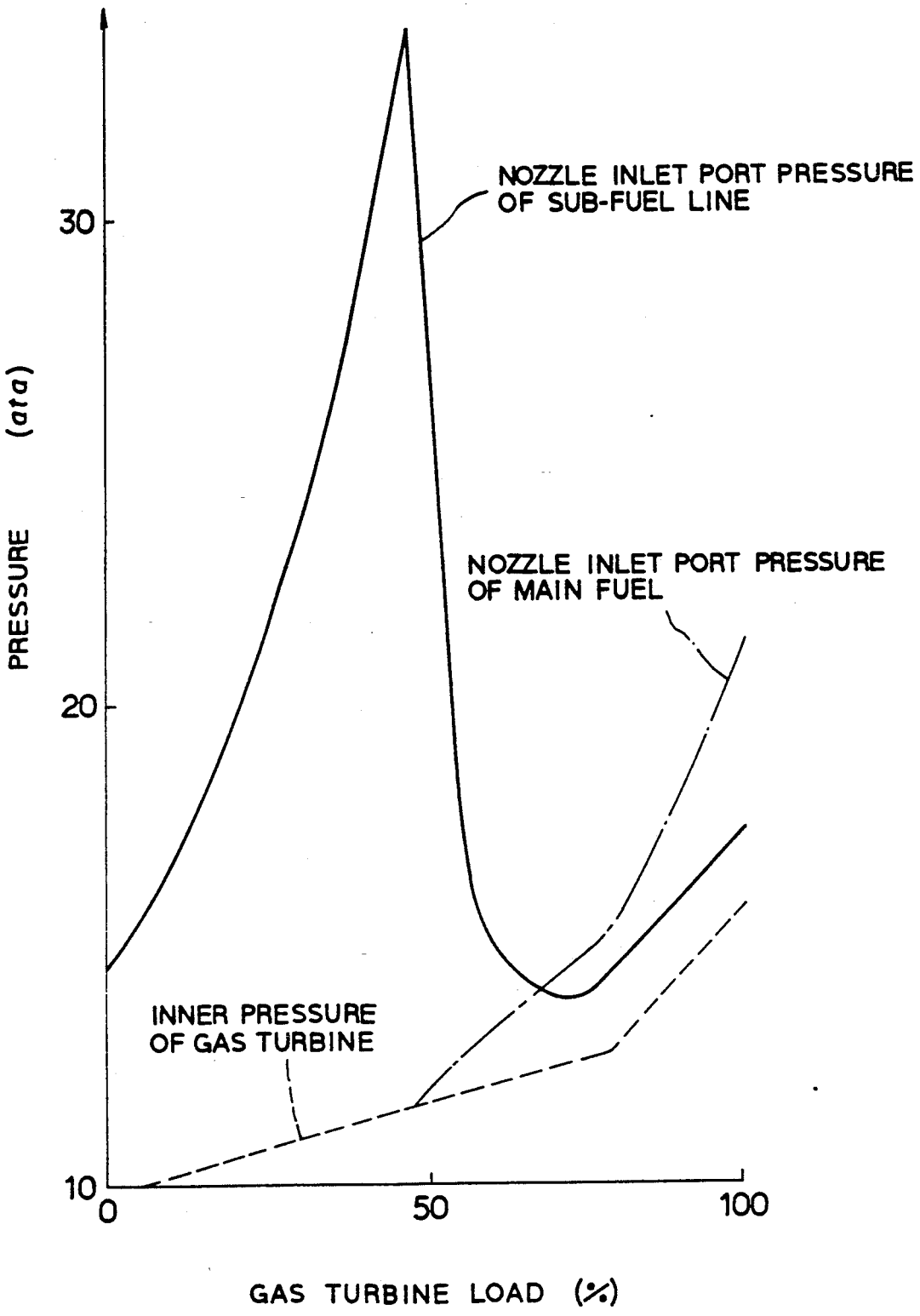
FIG. 8 is a graph showing pressure change in the respective fuel lines according to the prior art.

In the operation under a load more than the switching load, the fuel is introduced into the main fuel line 15, and the main distributing valve 25 is then gradually opened and the sub-distributing valve 26 is hence closed. At the load operating point J in FIG. 3, the main distributing valve 25 is fully opened and the subdistributing valve 26 is fully closed. During the operation from the switching load to the J point load, the fuel flow rate contol valve 14 is being opened gradually so as to increase the fuel flow rate in accordance with the requirement of the gas turbine load. FIG. 4 shows pressure variation in the respective fuel lines or systems shown in FIG. 3. FIG. 4 shows a case, for example, where the pressure ratio at the rated point is about a value of 16, the pressure at the nozzle inlet port of the sub-fuel line 15 has a peak pressure largely lowered in comparison with that of FIG. 8 showing the pressure variation in the conventional technology, and in such case, the peak pressure is also no more than the maximum pressure in the line. Consequently, in comparison with FIG. 8, the maximum pressure in the line can be reduced by about 13 $kg/cm^2$, for example.

Figure 3:
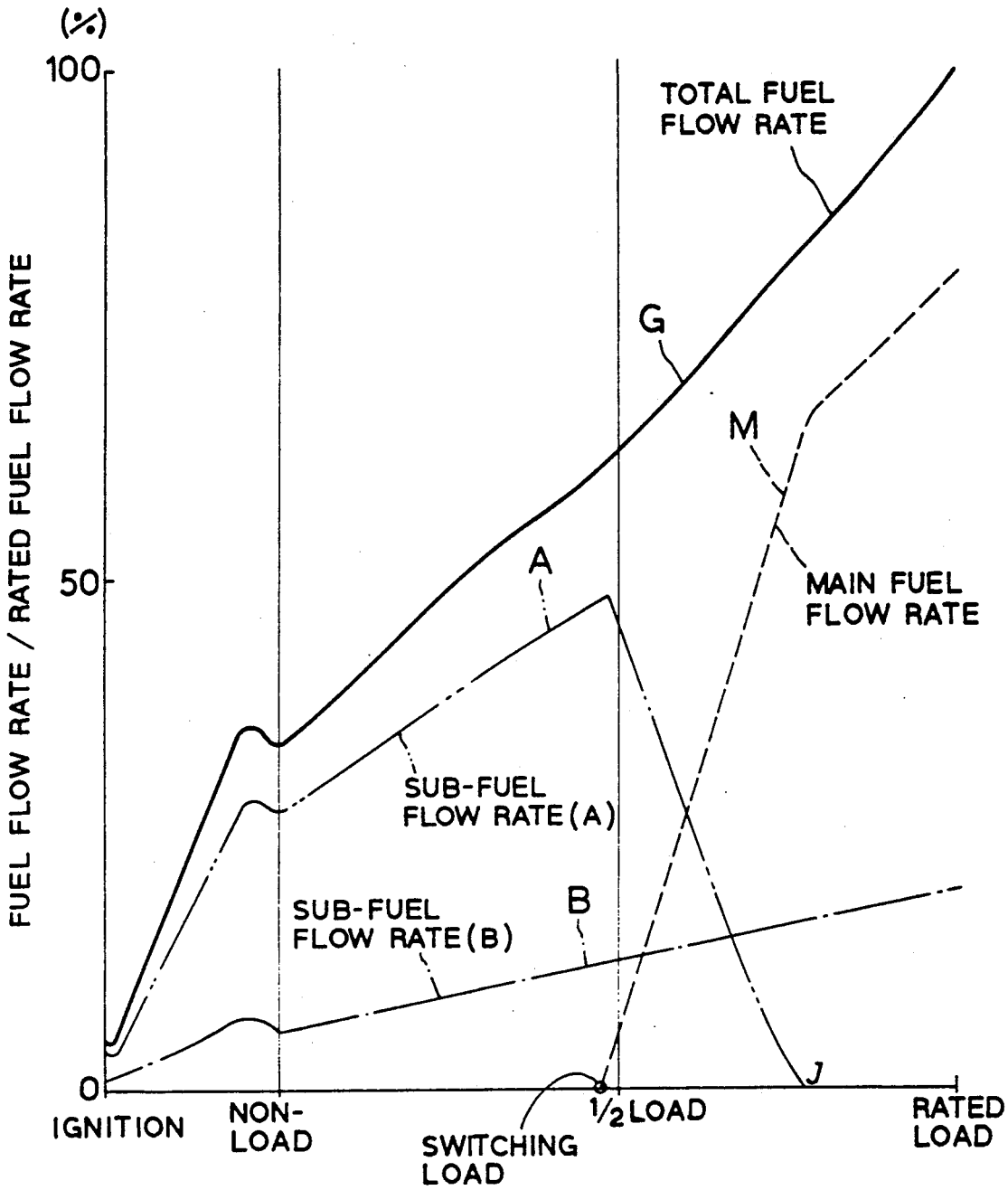
FIG. 3 is a graph showing fuel flow rate changes in the respective fuel lines for the gas turbine combustor of FIG. 1.
Figure 4:
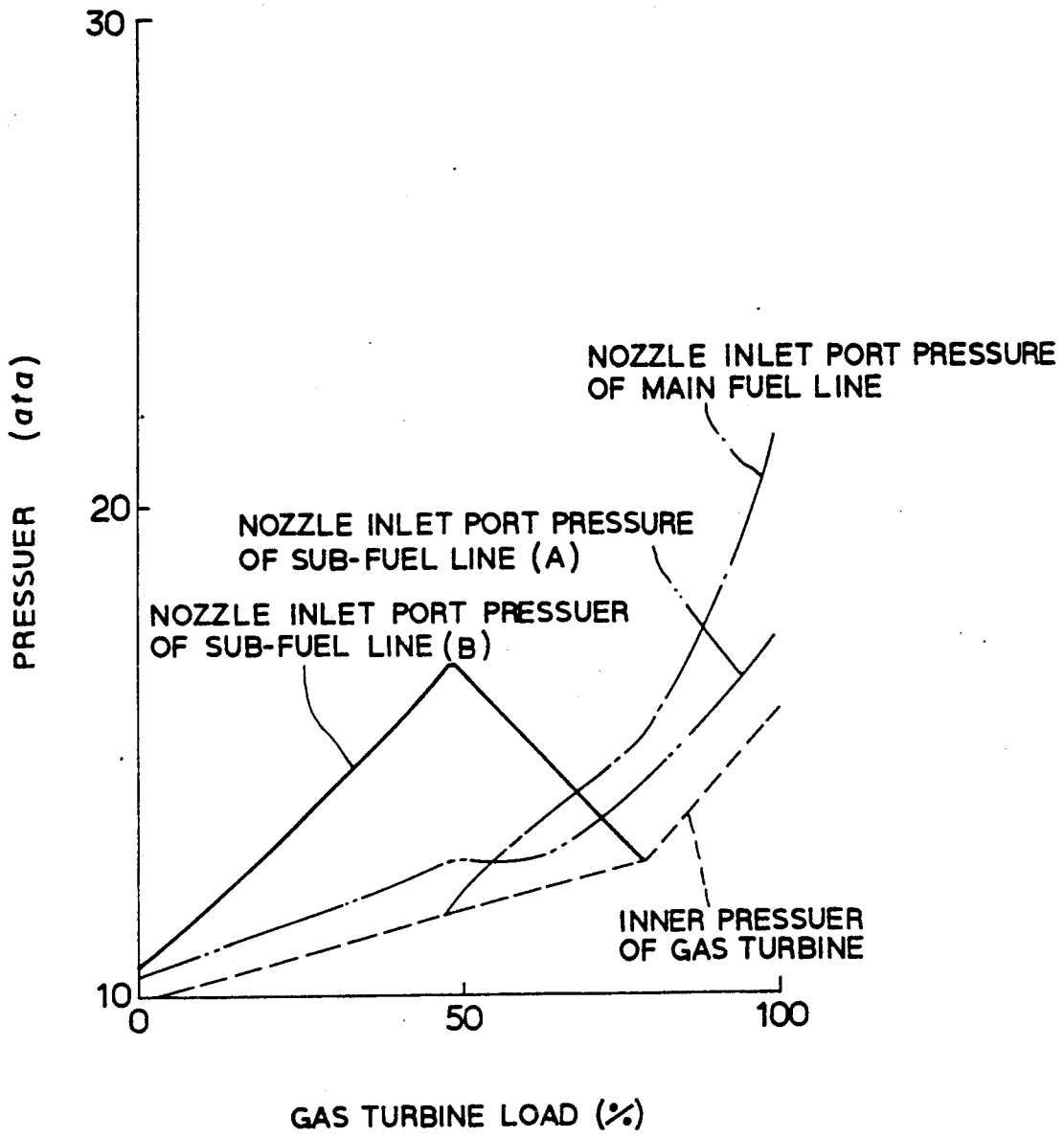
FIG. 4 is a graph showing fuel supply pressure changes in the respective fuel lines for the gas turbine combustor of FIG. 1.

According to the structures and characters of the present invention described above, a plurlaity of, two in this embodiment, sub-fuel lines 16a (A) and 16b (B) is arranged in the gas turbine combustor, after the switching of the load, the fuel nozzle of one of the sub-fuel lines is gradually closed in the assumption of the fuel distribution of the respective fuel lines of FIG. 7 and the fuel nozzles of another one of the sub-fuel lines and the main fuel line can keep the simple fuel flow rate characteristics in accordance with the load increasing of the gas turbine as shown in FIG. 3, in which the curve G denotes the total fuel flow rate, the curve A denotes the fuel flow rate in one 16a of the sub-fuel lines, the curve B represents the flow rate in another one 16b of the sub-fuel lines and M represents the flow rate in the main fuel line 15.

Namely, at the ignition of the gas turbine, both the fuel nozzles of the sub-fuel lines 16a and 16b are utilized and the distributing valve in the sub-fuel line keeps its opening degree of 100 %. The fuel flow rate in response to the starting sequence of the gas turbine is adjsuted by the fuel flow rate control unit disposed upstream side thereof.

After reaching the rated speed of the gas turbine operation, the fuel flow rates of both the fuel lines increase simply till the load reaches the switching load at which the fuel starts to flow in the main fuel line. At this time, the sub-fuel line 16b providing the maximum gas fuel supply pressure remains as separated at the rated speed time and the fuel flow rate in this sub-fuel line 16b simply increases, so that an extreme increasing of the fuel nozzle pressure ratio can be prevented.

Meanwhile, at the load point J in FIG. 3 of the sub-fuel line 16a, the fuel supply is throttled to substantially zero, so that even if the pressure lowers below the limit nozzle pressure ratio near this load point, the distributing valve in the sub-fuel line is then fully closed, thus preventing the problem caused in the conventional technology. That is, below the switching load operation, the fuel is mainly supplied to the main fuel line 15 and the fuel supplied to one 16a of the sub-fuel lines in which the distributing valve 26 is incorporated is throttled in response to the fuel supply rate to the main fuel line. The sub-distributing valve 26 is gradually closed and then fully closed before the nozzle pressure ratio of the fuel nozzle of the sub-fuel line 16a lowers below the limit pressure ratio.

During this control mode, the distributing valve incorporated in the main fuel line 15 is gradually opened for the compensation of the opening degree of the sub-distributing valve 26 and then fully opened at the instance of the full closing of the distributing valve 26 of the sub-fuel line 16a. Thereafter, the fuel flow rates in the main fuel line 15 and sub-fuel line 16b increase under the control of the fuel supply control unit 28.

Consequently, the fuel flow rates in the fuel nozzles in this embodiment increase basically in accordance with the increasing of the load of the gas turbine, and accordingly, in the assumption of the suitable nozzle pressure ratio being ensured at the maximum fuel flow rate, the necessity for a high nozzle pressure ratio at the local load area can be prevented and the lowering of the nozzle pressure ratio below the limit nozzle pressure ratio in the actual operating range can be also prevented. Therefore, there is no problem for supply gas fuel pressure in the use of the supply fuel gas pressure in the conventional gas turbine combustor.

In the preferred embodiment, since the respective nozzle holes of the sub-fuel nozzles are opened to the combustion air passage in the swirling vanes of the swirler 21, the fuel can be mixed to some extent with the fresh combustion air before the contact to the high temperature circulation gas for the ignition. Accordingly, a high increase of combustion temperature can be avoided. Furthermore, all the nozzle holes are opened in the swirling vanes, so that the fuel can be jetted and diffused into the combustion liner along the primary combustion air passing through the swirling vanes. Thus, the high temperature gas circulation formed in the primary combustion area can be controlled as expected by setting, in an optimum manner, the inwardly oriented angles and the swirling angles of the swirling vanes so as to perform the uniform combustion. Furthermore, the combustion area in the radial direction of the combustion liner can be widened, thus mixing the premixture fuel with the primary combustion area and hence achieving the uniform combustion, resulting in the improvement of the combustion efficiency and the lowering of the generation of the NOx.

According to this embodiment, the working power for the gas fuel compressor can be reduced as well as easy construction of the fuel compressor and the durable pressure to the system units or lines can be also reduced, which result in the improvement of the plant working efficiency and the safeness of the machineries. The working cost can thus be economized.

Furthermore, in this embodiment, the sub-fuel nozzle ports 22a and 22b are opened to the air swirling vanes 21a of the swirler 21, and hence, the sub-fuel passing along the primary combustion air through the swirling vanes 21a is jetted and diffused in the combustor liner 17. Since the inwardly oriented angles and the swirling angles of the air swirling vanes 21a are designed to the optimum values for the uniform combustion of the premixture fuel, the premixture fuel is swirled in the primary combustion area to form a circulation flow 29 realizing the uniform combustion.

Figure 5:
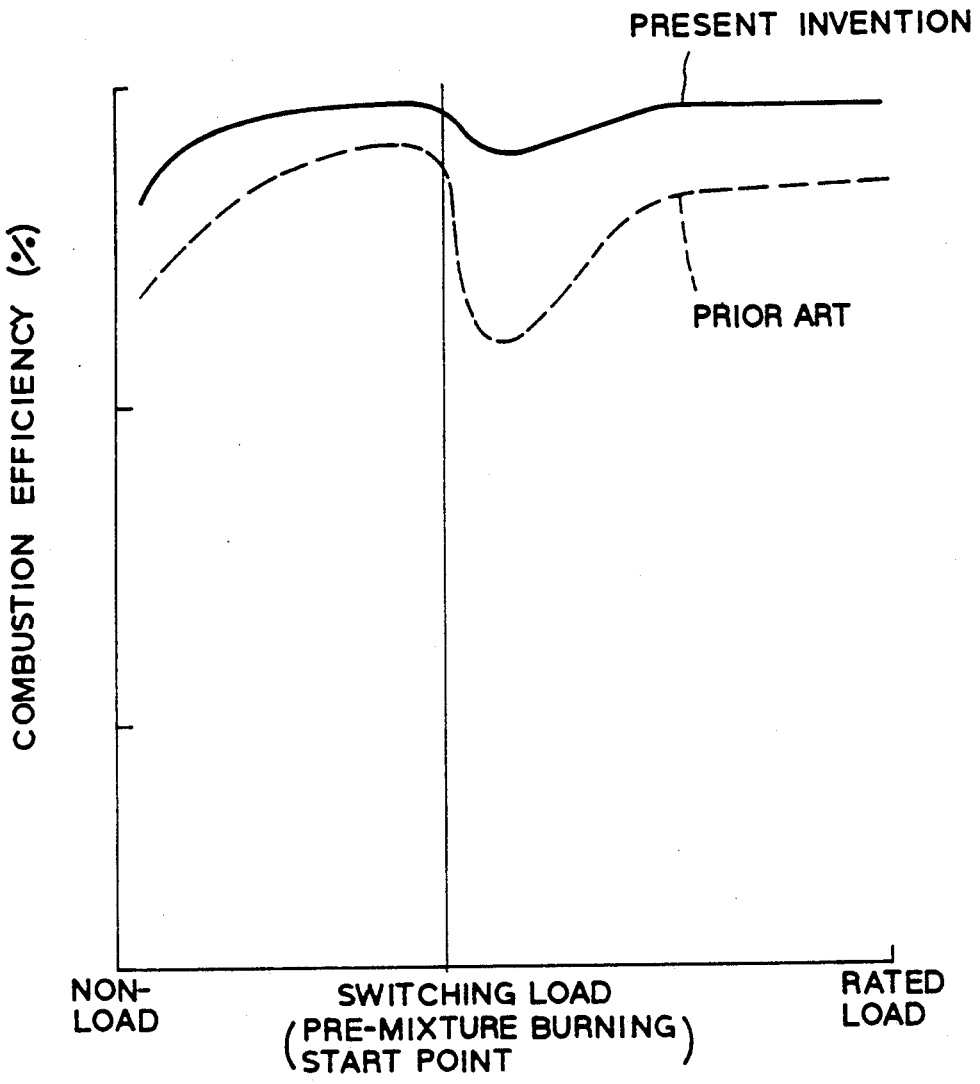
FIG. 5 is a graph showing a comparison of the combustion efficiencies between the present invention and the prior art.
Figure 6:
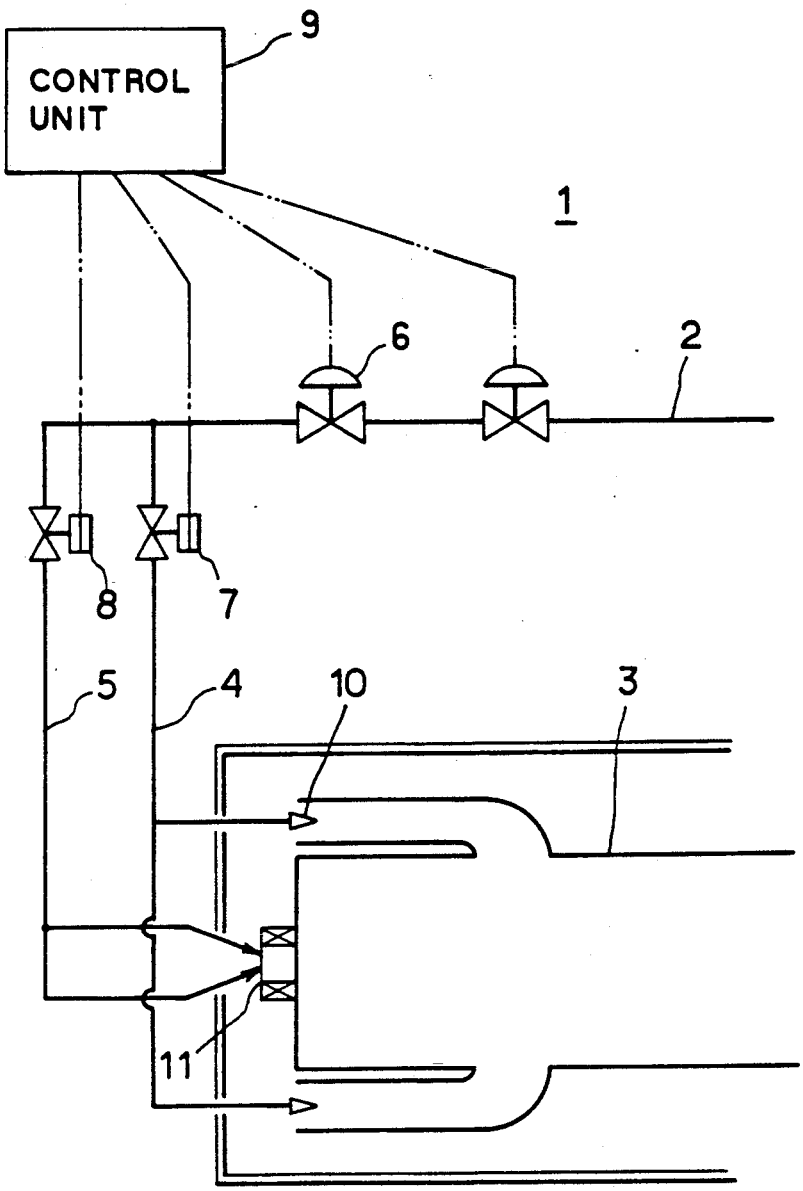
FIG. 6 PRIOR ART
FIG. 6 is a system diagram of a gas turbine combustor of a conventional structure.

Accordingly, as shown in FIG. 5 with a solid line, the combustion efficiency of the present embodiment is significantly improved in comparison with that of the conventional technology shown with a broken line.

In the described embodiment, the fixed oriffice 27 is incorporated in the sub-fuel line 16b, but the fixed orifice 27 may be replaced with an adjusting valve for performing a minute pressure adjustment. Moreover, the double-pipe structure of the sub-fuel nozzle 19 may be replaced with a plurality of small fuel nozzle members to deal with the flow rate change in the sub-fuel line in accordance with the number of the small fuel nozzle elements.

In a system design, when further, more than two as described above as a preferred embodiment, sub-fuel lines are incorporaed in the system, each of the sub-fuel lines like 16a of FIG. 1 will be assembled, which is incorporated with a sub-distributing valve like 26 in FIG. 1.

What is claimed is:

1. A gas turbine combustor for a gas turbine power plant comprising:

a combustion liner operatively connected to a turbine, said combustion liner being provided with a main fuel nozzle assembly and a sub-fuel nozzle assembly having nozzle holes for injecting fuel to an inside of the combustion liner through said nozzle holes;

a base fuel supply line having one end connected to a fuel source;

a main fuel line extending from said base fuel supply line for supplying a fuel from the base fuel line to the main fuel nozzle assembly and injecting the fuel through the nozzle hole of the main fuel nozzle assembly into a premixing assembly where the fuel is premixed with air and supplied to said combustion liner for permitting a lean-burning in the combustion liner;

a plurality of sub-fuel lines extending from said base fuel supply line for supplying the fuel from the base fuel supply line to the sub-fuel nozzle assembly for mixing the fuel with a combustion air in said combustion liner so as to permit a diffusion burning in the combustion liner, wherein said main and sub-fuel lines branch from the base fuel supply line;

distributing valve means provided in the main fuel line and at least one of the sub-fuel lines for distributing the fuel into the main and sub-fuel lines; and a control unit for controlling an opening amount of the distributing valve means so as to control a fuel flow through said distributing valve means and thereby control a fuel distribution ratio to the main and sub-fuel lines;

wherein a fixed orifice is provided in an other one of said sub-fuel lines which maintains a fuel flow through said other one of the sub-fuel lines.

2. A gas turbine combustor according to claim 1, wherein said sub-fuel nozzle assembly includes a swirler provided with swirling vanes at an end portion of said sub-fuel nozzle assembly inserted in the combustion liner for swirling the fuel therein.

3. A gas turbine combustor according to claim 2, wherein said swirling vanes are provided with a combustion air passage to which the nozzle holes of the sub-fuel nozzle assembly are opened.

* * * * *